US011299847B2

(12) United States Patent
Chae et al.

(10) Patent No.: US 11,299,847 B2
(45) Date of Patent: Apr. 12, 2022

(54) CLOTHING TREATMENT APPARATUS AND CONTROLLING METHOD THEREOF

(71) Applicant: Samsung Electronics Co., Ltd., Suwon-si (KR)

(72) Inventors: Gyeongryeol Chae, Suwon-si (KR); Euiyoung Chang, Suwon-si (KR); Eungryeol Seo, Suwon-si (KR); Heetae Lim, Suwon-si (KR); Judai Kim, Suwon-si (KR); Jinyoung Choi, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 128 days.

(21) Appl. No.: 16/568,712

(22) Filed: Sep. 12, 2019

(65) Prior Publication Data

US 2020/0080255 A1 Mar. 12, 2020

(30) Foreign Application Priority Data

Sep. 12, 2018 (KR) ..... 10-2018-0109258

(51) Int. Cl.
*D06F 73/02* (2006.01)
*D06F 58/10* (2006.01)
(Continued)

(52) U.S. Cl.
CPC ..... *D06F 73/02* (2013.01); *D06F 58/10* (2013.01); *D06F 58/36* (2020.02); *D06F 2103/00* (2020.02); *D06F 2105/44* (2020.02)

(58) Field of Classification Search
CPC ..... D06F 58/10; D06F 73/02; D06F 58/36; D06F 2105/44; D06F 2103/00
See application file for complete search history.

(56) References Cited

U.S. PATENT DOCUMENTS 2,221,351 A * 11/1940 Kempf ..... F26B 11/14 34/60
2,487,175 A * 11/1949 Petre ..... D06C 5/005 223/61
(Continued)

FOREIGN PATENT DOCUMENTS

CN 2755147 2/2006
EP 3722493 10/2020
(Continued)

OTHER PUBLICATIONS

International Search Report and Written Opinion of the International Searching Authority dated Dec. 18, 2019 in International Patent Application No. PCT/KR2019/011756.
(Continued)

*Primary Examiner* — Benjamin L Osterhout
(74) *Attorney, Agent, or Firm* — Staas & Halsey LLP

(57) ABSTRACT

A clothing treatment apparatus and method thereof is provided. The clothing treatment apparatus according to an embodiment includes a main body formed with a space to accommodate clothing, a sprayer disposed inside the main body and configured to spray at least one of steam or air toward the clothing while the clothing is accommodated in the space, and a door connectable to the main body to open and close the space, wherein the door includes a first inlet to allow air from an outside to flow, a second inlet connectable to the first inlet and through which the air from the first inlet flows to the space while the second inlet is connected to the first inlet, and a shutter configured to selectively move toward the second inlet to close the second inlet and move away from the second inlet to open the second inlet.

12 Claims, 11 Drawing Sheets

(51) Int. Cl.

| | |
|---|---|
| ***D06F 58/36*** | (2020.01) |
| *D06F 103/00* | (2020.01) |
| *D06F 105/44* | (2020.01) |

(56) References Cited

U.S. PATENT DOCUMENTS

| | | | | |
|---|---|---|---|---|
| 3,383,776 | A * | 5/1968 | Wilhoyte | D06F 58/10 34/562 |
| 3,805,561 | A * | 4/1974 | Bullock | D06F 73/02 68/5 C |
| 5,094,020 | A * | 3/1992 | Wingfield | D06F 73/02 223/51 |
| 5,561,880 | A * | 10/1996 | Allen | D06F 73/02 223/51 |
| 5,815,961 | A * | 10/1998 | Estes | D06F 73/02 38/14 |
| 6,189,346 | B1 * | 2/2001 | Chen | D06F 73/02 68/5 R |
| 6,622,529 | B1 * | 9/2003 | Crane | D06F 43/00 68/5 C |
| 6,868,621 | B1 * | 3/2005 | Grimm | D06F 34/26 34/92 |
| 8,006,336 | B1 * | 8/2011 | Gerlach | D06F 58/14 8/158 |
| 8,245,414 | B2 | 8/2012 | Watson et al. | |
| 8,258,733 | B2 | 9/2012 | Yoon et al. | |
| 2002/0154011 | A1 * | 10/2002 | Pasin | D06F 73/02 340/540 |
| 2003/0126691 | A1 * | 7/2003 | Gerlach | D06F 87/00 8/158 |
| 2004/0163184 | A1 * | 8/2004 | Waldron | D06F 73/02 8/149.1 |
| 2004/0163422 | A1 | 8/2004 | Kim et al. | |
| 2005/0120757 | A1 * | 6/2005 | Jackson | D06F 73/02 68/5 C |
| 2005/0257440 | A1 * | 11/2005 | Seiffert | D06F 73/02 52/79.1 |
| 2009/0151188 | A1 | 6/2009 | Moon et al. | |
| 2009/0255141 | A1 * | 10/2009 | Moon | D06F 58/10 34/72 |
| 2010/0282785 | A1 * | 11/2010 | Roselle | D06F 58/203 223/61 |
| 2011/0005276 | A1 * | 1/2011 | Moon | D06F 73/02 68/6 |
| 2012/0111066 | A1 * | 5/2012 | Hayashi | D06F 25/00 68/19 |
| 2014/0238086 | A1 * | 8/2014 | Choi | D06F 58/206 68/20 |

FOREIGN PATENT DOCUMENTS

| | | |
|---|---|---|
| JP | 3321945 | 9/2002 |
| JP | 3389434 | 3/2003 |
| JP | 2017-23453 | 2/2017 |
| KR | 2003-0061192 | 7/2003 |
| KR | 10-0782377 | 12/2007 |
| KR | 10-2008-0105499 | 12/2008 |
| KR | 10-2009-0102401 | 9/2009 |
| KR | 10-0926065 | 11/2009 |
| KR | 10-2012-0073576 | 7/2012 |
| KR | 10-2013-0015240 | 2/2013 |
| KR | 10-1605752 | 3/2016 |
| KR | 10-1614158 | 4/2016 |

OTHER PUBLICATIONS

Extended European Search Report, dated Aug. 6, 2021, in European Patent Application No. 19859586.0 (11 pp.).

* cited by examiner

CLOTHING TREATMENT APPARATUS AND CONTROLLING METHOD THEREOF

CROSS-REFERENCE TO RELATED APPLICATIONS

This application is based on and claims priority under 35 U.S.C. § 119 to Korean Patent Application No. 10-2018-0109258, filed on Sep. 12, 2018, in the Korean Intellectual Property Office, the disclosure of which is incorporated herein by reference in its entirety.

BACKGROUND

1. Field

Devices and methods disclosed herein relate to a clothing treatment apparatus with improved airtightness and a controlling method thereof.

2. Description of the Related Art

In general, washing machines have been widely used as apparatuses for cleaning materials made of fabrics such clothing, bedding, etc. Processes of dehydration and drying are added to the washing machine separately since laundry is cleaned through friction between washing water accommodated in a water tank and the laundry.

Recently, as devices for managing clothes more convenient than before are developed, clothing treatment apparatuses capable of removing wrinkles, dust or smell of clothing without an additional washing process using cleaning water have been used.

The clothing treatment apparatuses spray steam or air on clothing to stretch out wrinkles of the clothing or deodorize the clothing. Also, in order to prevent steam or air from leaking out, the space in which the clothes are place is gas tight with the outside.

In order to prevent the child from entering the clothes treatment apparatus and being suffocated when the inside of the clothes treatment apparatus is airtight, the clothes treatment apparatus has a choking prevention structure that is ventilated with the inside and outside of the clothes treatment apparatus.

However, such a choking prevention structure has a problem that the efficiency of the clothing treatment is reduced because the apparatus is not ventilated with the outside and airtightness with the outside is not ensured even when the clothing treatment apparatus is operated.

SUMMARY

An aspect of the embodiments relates to providing a clothing treatment apparatus with improved selective airtightness and a controlling method of a clothing treatment apparatus.

According to an embodiment, there is provided a clothing treatment apparatus including a main body formed with a space to accommodate clothing, a sprayer disposed inside the main body and configured to spray at least one of steam or air toward the clothing while the clothing is accommodated in the space, and a door connectable to the main body to open and close the space, wherein the door includes a first inlet to allow air from an outside to flow, a second inlet connectable to the first inlet and through which the air from the first inlet flows to the space while the second inlet is connected to the first inlet, and a shutter configured to selectively move toward the second inlet to close the second inlet and move away from the second inlet to open the second inlet.

The shutter may include a rotational shaft connected to an inside of the door, a driving motor connected to one side of the rotational shaft and configured to rotate the rotational shaft, and a closing member connected to the rotational shaft and configured to close the second inlet as the rotational shaft rotates.

A shape of the closing member may correspond to a shape of the second inlet, wherein an air tightness member contacting the second inlet is disposed on a surface of the closing member.

The apparatus may further include a processor configured to control the driving motor to be in an open state that opens the second inlet and a closed state that closes the second inlet.

The first inlet and the second inlet may form a main air flow path that connects the outside to the space by a short distance, wherein the processor is further configured to control the driving motor to allow the shutter to be spaced apart from the main air flow path in the open state.

The processor may be further configured to control the driving motor to maintain the second inlet in the closed state.

According to an embodiment, there is provided a controlling method of a clothing treatment apparatus, the method including operating a clothing treatment apparatus which includes a space to accommodate clothing, closing an inlet that allows air to flow from an outside to the space as a shutter rotates in a first direction, and opening the inlet as the shutter rotates in a second direction opposite to the first direction after the operating of the clothing treatment apparatus ends.

The method may further include stopping the clothing treatment apparatus from being operated while the door is open, and opening the inlet as the shutter rotates in the second direction after the door is closed.

The method may further include re-operating the clothing treatment apparatus, and closing the second inlet as the shutter rotates in the first direction.

DETAILED DESCRIPTION

In order to fully understand the structure and effects of the disclosure, preferable embodiments of the disclosure will be described with reference to the accompanying drawings. The disclosure may, however, be embodied in many different forms and should not be construed as limited to the embodiments set forth herein. It should be understood, however, that the description of the embodiments is provided to enable the disclosure of the disclosure to be complete, and will fully convey the scope of the disclosure to a person having ordinary skill in the art to which the disclosure belongs. In the accompanying drawings, the constituent elements are enlarged in size for convenience of explanation and the proportions of the constituent elements can be exaggerated or reduced.

When an element (e.g., a first constituent element) is referred to as being "operatively or communicatively coupled to" or "connected to" another element (e.g., a second constituent element), it should be understood that each constituent element is directly connected or indirectly connected via another constituent element (e.g., a third constituent element). However, when an element (e.g., a first constituent element) is referred to as being "directly coupled to" or "directly connected to" another element (e.g., a second constituent element), it should be understood that there is no other constituent element (e.g., a third constituent element) interposed therebetween.

The terms such as "first," "second," and so on may be used to describe a variety of elements, but the elements should not be limited by these terms. The terms are used simply to distinguish one element from other elements. For example, without departing from the scope of the disclosure, the first element may be referred to as a second element, and similarly, the second element may also be referred to as a first element.

The singular expression also includes the plural meaning as long as it does not differently mean in the context. In this specification, terms such as 'include' and 'have/has' should be construed as designating that there are such characteristics, numbers, operations, elements, components or a combination thereof in the specification, not to exclude the existence or possibility of adding one or more of other characteristics, numbers, operations, elements, components or a combination thereof.

Unless otherwise defined, all terms (including technical and scientific terms) used herein have the same meaning as commonly understood by one of ordinary skill in the art to which this disclosure belongs.

Figure 1:
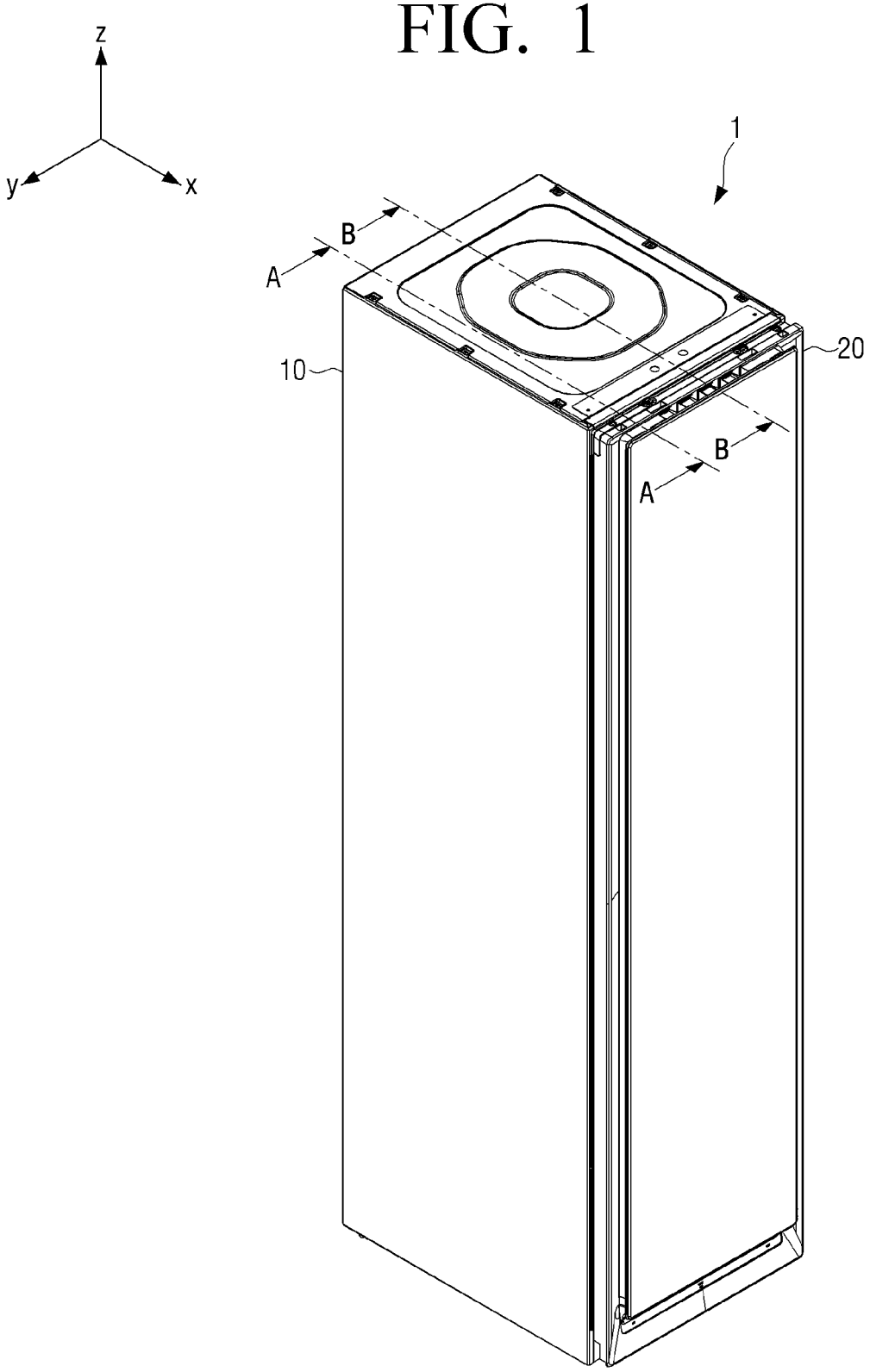
FIG. 1 is a perspective view illustrating a clothing treatment apparatus according to an embodiment of the disclosure.
Figure 2:
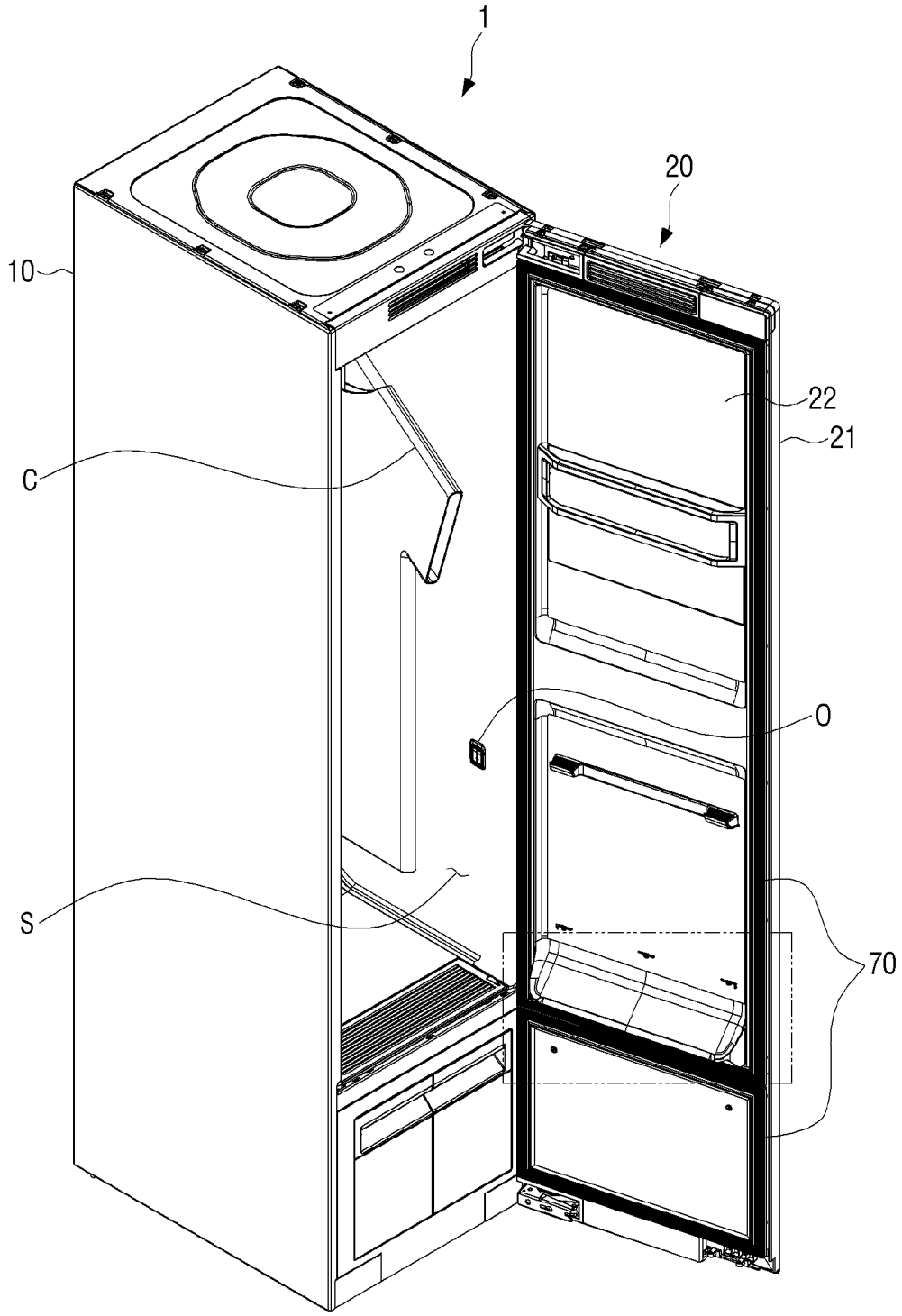
FIG. 2 is a perspective view illustrating a clothing treatment apparatus when a door is opened.
Figure 3:
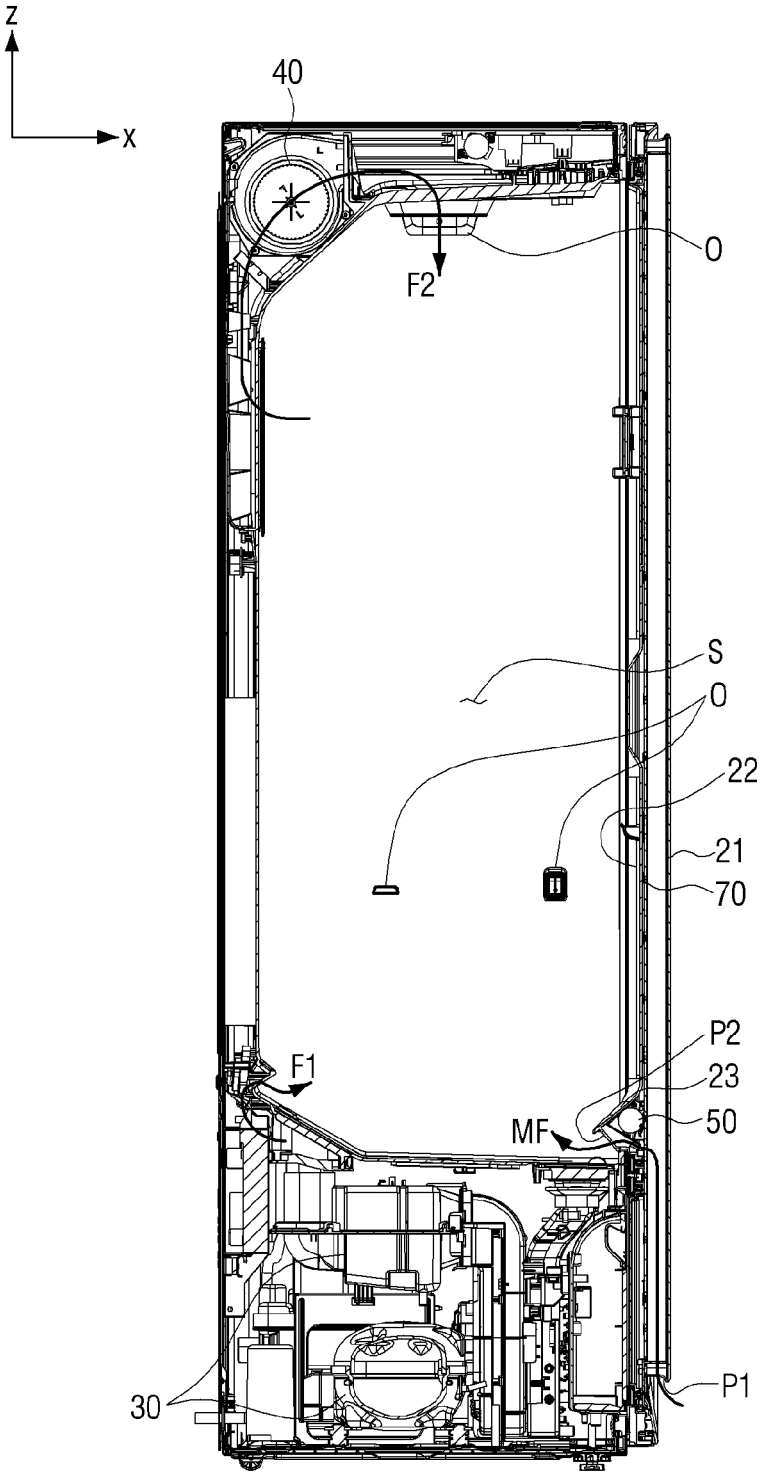
FIG. 3 is a cross-sectional view taken along line A-A of FIG. 1.

FIG. 1 is a perspective view illustrating a clothing treatment apparatus 1 according to an embodiment of the disclosure, FIG. 2 is a perspective view illustrating a clothing treatment apparatus 1 when a door 20 is opened, and FIG. 3 is a cross-sectional view taken along line A-A of FIG. 1.

Referring to FIG. 1 and FIG. 2, a clothing treatment apparatus 1 may include a door 20 pivotally combined with a main body 10 equipped with an accommodation space S inside.

The main body 10 may form the outside of the clothing treatment apparatus 1, and include the accommodation space S for accommodating items such as clothing C inside, a spray unit (sprayer) 30 disposed under the accommodation space S, a plurality of spray holes O disposed toward the accommodation space S so that air or steam discharged from the spray unit 30 may be sprayed, and a circulation fan 40 that circulates air or steam discharged from the spray unit 30 into the accommodation space S.

The accommodation space S may be formed to be large enough to accommodate the clothing C in the main body 10, and the shape thereof may vary to the extent necessary.

The accommodation space S may be sealed to the outside apart from the plurality of spray holes O when the clothing treatment apparatus 1 operates. Accordingly, wrinkles of the clothing C placed in the accommodation space S may be stretched out by the air or steam sprayed from the plurality of spay holes O in the sealed space, and the smell of the clothing C may be deodorized.

Referring to FIG. 3, the spray unit 30 may be disposed inside the main body 10, and may spray at least one of steam or air toward the clothing C.

The spray unit 30 may inhale air flowing into from the outside or air in the accommodation space S, dehydrate or heat the inhaled air selectively and spray the air to the inside of the accommodation space S in which the clothing C is placed.

In addition, the spray unit 30 may not only hydrate or heat the inhaled air but also mix the inhaled air with hot vapor to spray air in the form of steam to the accommodation space S in which the clothing C is placed.

Accordingly, the spray unit 30 may implement air in various states to be sprayed into the accommodation space S according to a user's selection of processing the clothing C.

The plurality of spray hole O may be disposed in each of the upper, lower, left and right of the accommodation space (S), and may spray air formed in the spray unit 30 toward the clothing C disposed in the accommodation space S.

The plurality of spray holes O may be disposed in various positions in the accommodation space S according to selection.

The circulation fan 40 may be disposed on a path on which air flows from the spray unit 30 to the accommodation space S, and move the air discharged from the spray unit 30 to the plurality of spray holes O disposed in the accommodation space S.

The circulation fan 40 may inhale external air into the clothing treatment apparatus 1 or discharge the air, and circulate air of the clothing treatment apparatus 1 overall.

FIG. 3 illustrates that the circulation fan 40 is an axial flow fan, but the present invention is not limited to a particular type of fan and any type of fan may be used depending on needs.

Referring to FIG. 2, a door 20 may be provided in the main body 10 to close and open the accommodation space S.

The door 20 may form one surface of the outside of the clothing treatment apparatus 1 and partition the outside of the clothing treatment apparatus 1 and the accommodation space S.

The door 20 may include a front place 21 and a rear plate 22 disposed on the rear surface of the front plate 21.

A display (not shown) for a user to control the operation of the clothing treatment apparatus 1 and the state of the clothing treatment apparatus 1 may be disposed on the front plate 21.

The rear place 22 may cover one side surface of the main body 10, and may have a larger cross-section than the front plate 21.

In addition, the rear plate 22 may be formed to be spaced apart from the front plate 21 at predetermined intervals to allow external air to flow in along the edge of the front plate 21.

A main air flow path MF through which external air flows and a first inlet P1 corresponding to the inlet of the main air flow path MF may be formed between the rear plate 22 and the front plate 21.

A gasket 70 contacting the edge of the main body 10 may be disposed on the edge of the rear surface of the rear plate 22. Accordingly, the rear plate 22 may be disposed on one side surface of the main body 10 to close the inside of the main body 10.

Figure 9A:
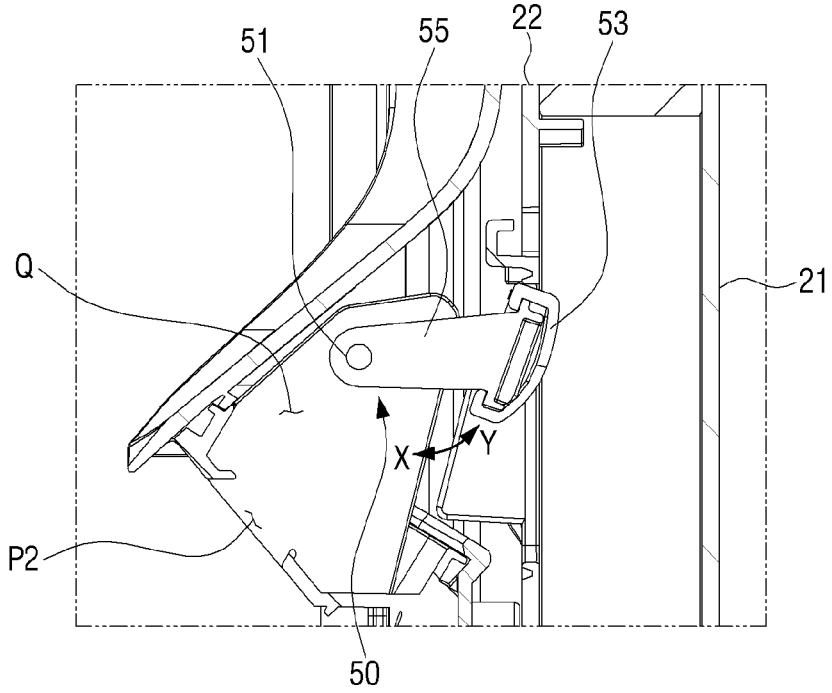
FIG. 9A is a cross-sectional view illustrating an open state of a shutter.

In addition, a cover 23 combined with one surface of the rear surface 22 may be included to form the main air flow path MF and an arrangement space Q in which the shutter 50 is disposed (see FIG. 9A).

The cover 23 may protrude toward the accommodation space S, and accordingly, the shutter 50 for selectively opening and closing the second inlet P2 may be disposed inside the cover 23.

The door 20 may include the first inlet P1 connected to the outside, the second inlet P2 connecting the first inlet P1 to the accommodation space S, and the shutter 50 for selectively opening and closing the second inlet P2.

The first inlet P1 may be formed between the front plate 21 and the rear plate 22 along the edge of the door 20, and may form the inlet of the main air flow path MF through which external air of the clothing treatment apparatus 1 flows.

It has been illustrated that the first inlet P1 is formed under the door 20, but it is not limited thereto. The first inlet P1 may be formed in various shapes in various positions.

The second inlet P2 may form the outlet of the main air flow path MF, and connect the main air flow path MF to the accommodation space S. Accordingly, when the external air flows into the inside of the clothing treatment apparatus 1, the air may flow into the accommodation space S through the first inlet P1, the main air flow path MF and the second inlet P2.

In other words, the first inlet P1 and the second inlet P2 may form the main air flow path MF for connecting the outside of the clothing treatment apparatus 1 and the accommodation space S by the shortest distance.

Therefore, even if a person enters the clothing treatment apparatus 1 when the clothing treatment apparatus is not operated, the person in the clothing treatment apparatus 1 may be prevented from being suffocated through the structure in which the accommodation space S is ventilated from the outside.

Hereinafter, referring to FIG. 4, the flow path formed in the clothing treatment apparatus 1 will be described in detail.

Figure 4:
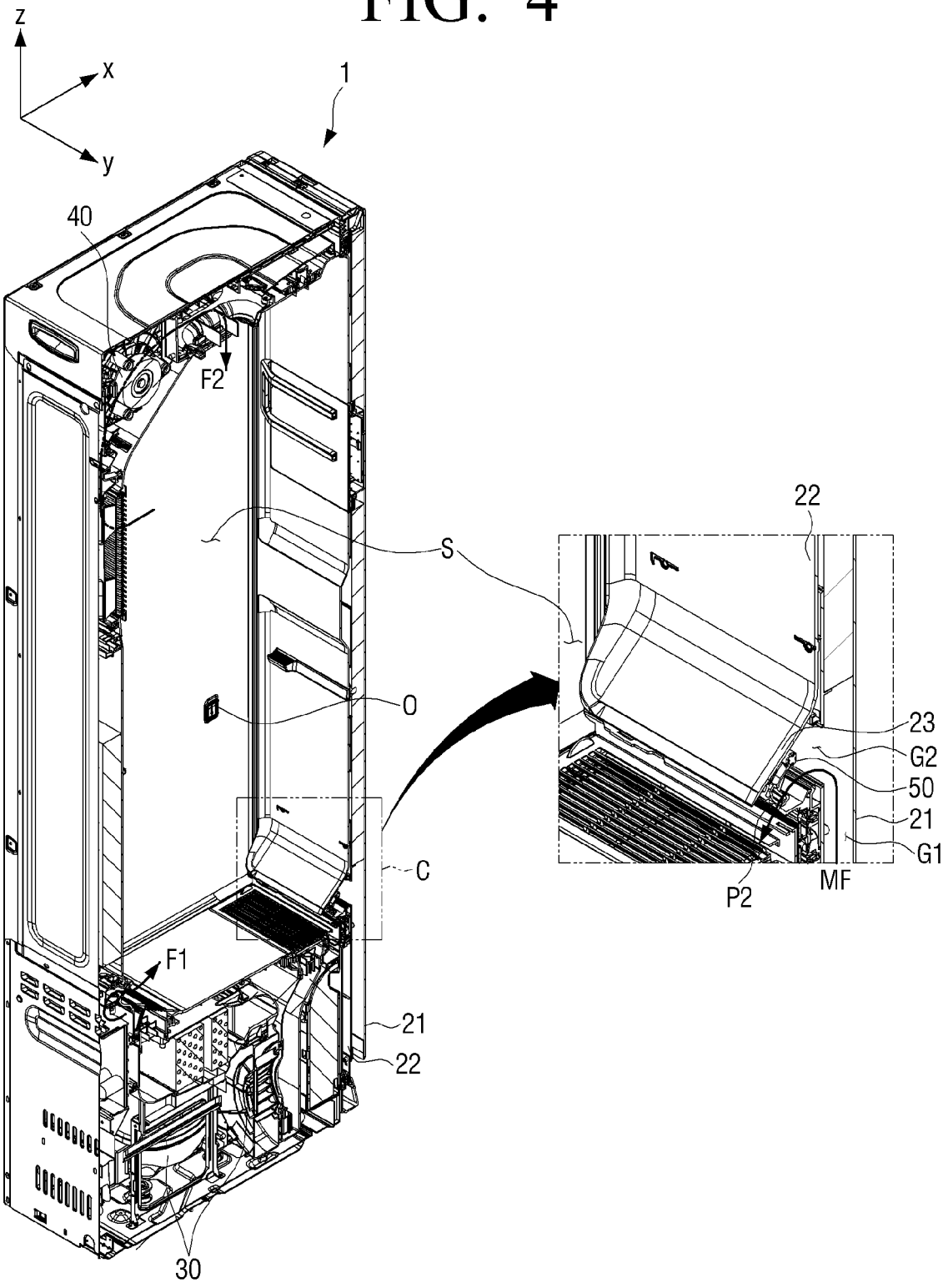
FIG. 4 is a cross-sectional perspective view taken along line B-B of FIG. 1.

FIG. 4 is a cross-sectional perspective view taken along line B-B of FIG. 1.

Referring to FIG. 4 including an area C of the clothing treatment apparatus, the main air flow path MF for connecting the outside of the clothing treatment apparatus 1 to the accommodation space S of the clothing treatment apparatus 1 may be formed through an arrangement space Q formed between the front plate 21 and the rear plate 22 of the door 20.

To be specific, the main air flow path MF may be formed through a first space G1 formed between the rear plate 22 and the front plate 21 and a second space G2 formed between the rear plate 22 and the cover 23.

The arrangement space Q may be the same as the second space G2.

Air flowing from the outside or air inhaled in the accommodation space S may be converted into air necessary for a user through the spray unit 30.

The air may be sprayed into the accommodation space S along the first and second circulation flow paths F1 and F2 by the circulation fan 40 disposed on the circulation flow paths F1 and F2.

The first and second circulation flow paths F1 and F2 may correspond to the path that air moves when the clothing treatment apparatus 1 is operated, and the main air flow path MF may be a path in which external air moves into the accommodation space S when the apparatus treatment apparatus 1 is not operated.

To be specific, the first circulation flow path F1 may be a path through which hot steam that changes its state in the spray unit 30 is discharged, and the second circulation flow path F2 may be a path to spray the air inhaled in the accommodation space S toward the clothing C, and remove dust of the clothing C.

However, the first and second circulation flow paths F1 and F2 may be embodies as various paths to the extent necessary. The state of air flowing through the first and second circulation flow paths F1 and F2 may vary.

In addition, the main air flow path MF may be closed by the shutter 50 to prevent the air sprayed into the accommodation space S of the clothing treatment apparatus 1 from being discharged to the outside when the clothing treatment apparatus 1 is operated.

Hereinafter, referring to FIG. 5 and FIG. 7, the detailed structure of the shutter 50 will be described.

Figure 5:
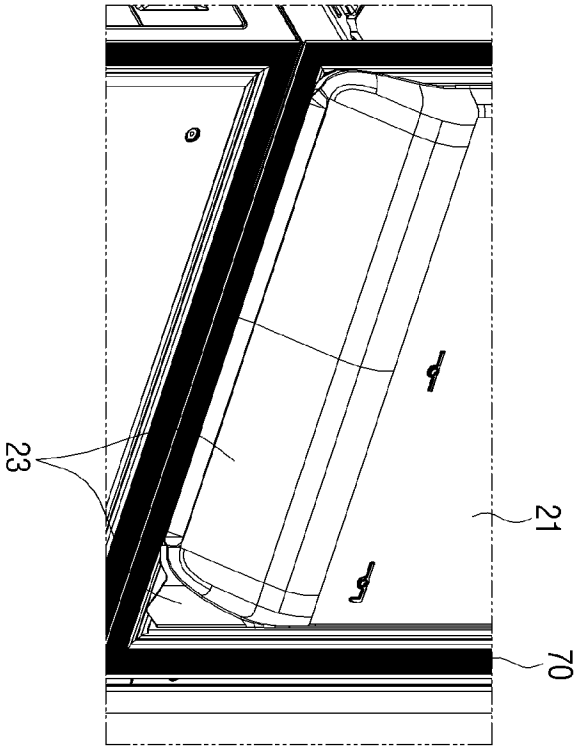
FIG. 5 is an enlarged perspective view illustrating part C of FIG. 2.
Figure 6:
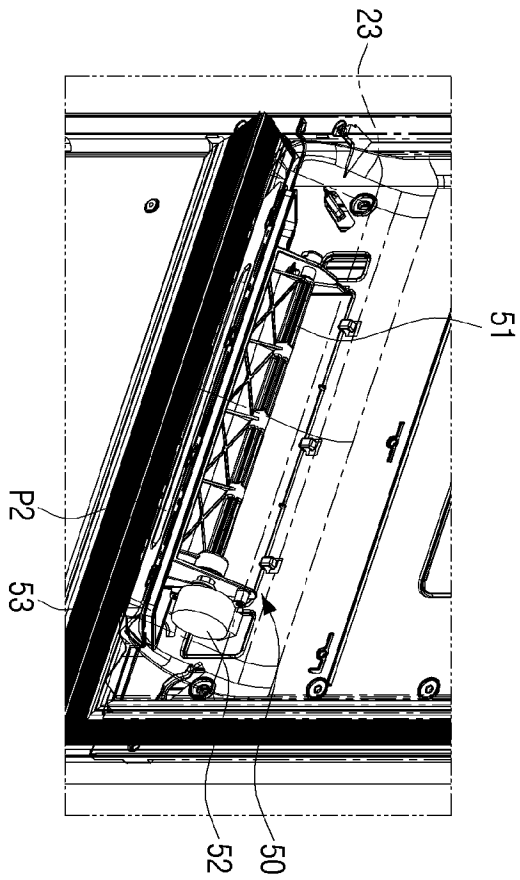
FIG. 6 is an enlarged perspective view illustrating a shutter of FIG. 5.
Figure 7:
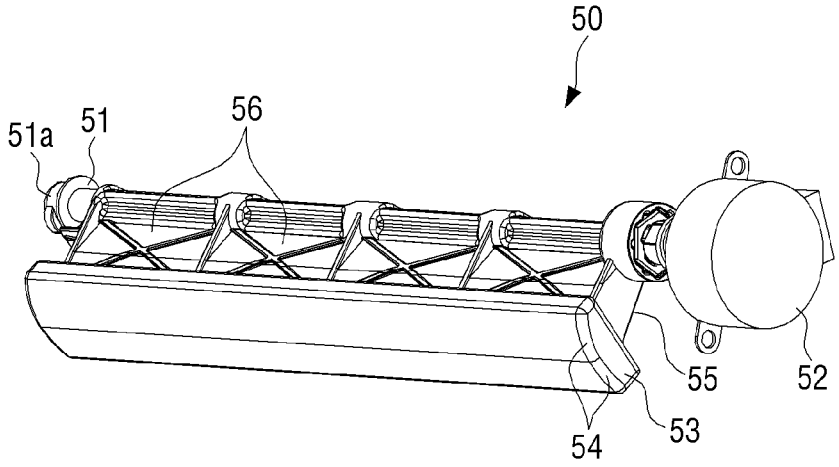
FIG. 7 is a perspective view illustrating a shutter.

FIG. 5 is an enlarged perspective view illustrating part C of FIG. 2, FIG. 6 is an enlarged perspective view illustrating a shutter 50 of FIG. 5, and FIG. 7 is a perspective view illustrating a shutter 50.

Referring to FIG. 5 and FIG. 6, the shutter 50 may be disposed in an arrangement space Q formed between the rear plate 22 and the cover 23 to selectively open and close the second inlet P2.

The rotational shaft 51 and the driving motor 52 of the shutter 50 may be fixed to one surface of the rear plate 22. Accordingly, the shutter 50 may rotate based on the rotational shaft 51 while being fixed to one surface of the rear plate 22 to selectively open and close the second inlet P2.

Referring to FIG. 7, the shutter 50 may include a rotational shaft 51 connected to the inside of the door, a driving motor 52 connected to one side of the rotational shaft 51 to rotate the rotational shaft 51, and a closing unit (member) 53 connected to the rotational shaft 51 to close the second inlet P2 as the rotational shaft 51 rotates.

A one end 51*a* of the rotational shaft 51 may be rotatably fixed to one surface of the rear plate 22, and the other end opposite to the one end 51*a* may be fixed to one surface of the rear plate 22 through the driving motor 52 connected to the other end of the rotational shaft 51.

Accordingly, the rotational shaft 51 may be disposed in parallel with one surface of the rear plate 22, and may rotate in connection with the driving motor 52.

The driving motor 52 may rotate the rotational shaft 51, and provide a driving force to the shutter 50. The driving motor 52 is illustrated as being disposed on one side of the rotational shaft 51, but disposed on one side of the clothing treatment apparatus 1 to the extent necessary to transmit a driving force to the rotational shaft 51 through various constituent elements.

The closing unit 53 may open and close the second inlet P2 in connection with the rotational shaft 51. The closing unit 53 may be connected to the rotational shaft 51 through a connection unit 55 extended at a predetermined interval in one direction from the rotational shaft 51.

The shape of the closing unit 53 may correspond to the shape of the second inlet P2. Accordingly, when the closing unit 53 closes the second inlet P2, the second inlet P2 may be completely closed, and the accommodation space S may be completely sealed to the outside of the clothing treatment apparatus 1.

In addition, an air tightness member 54 contacting the second inlet P2 may be disposed on the surface of the closing unit 53.

The air tightness member 54 may be configured to prevent the closing unit 53 from not completely closing the second inlet 52, and may be formed of an elastic material such as a gasket.

Accordingly, even if there is a small space between the second inlet P2 and the closing unit 53, the air tightness member 54 may fill the small space to block the accommodation space S from the outside of the clothing treatment apparatus 1.

In addition, a cover surface 56 may be disposed between the connection units 55 formed at predetermined intervals.

The cover surface 56 may cover the space between the respective connection units and the space between the rotational shaft 51 and the closing unit 53.

Accordingly, the cover surface 56 may integrally connect the connection unit 55, the rotational shaft 51, and the closing unit 53. The closing unit 53 may integrally move in parallel with the rotational shaft 51 according to the rotation of the rotational shaft 51.

The shutter 50 except the driving motor 52 may be integrally formed by injection molding. Accordingly, the manufacturing process of the shutter 50 may be simple to reduce the manufacturing costs.

Hereinafter, referring to FIG. 8 to FIGS. 9A and 9B, the operation of the shutter 50 will be described in detail.

Figure 8:
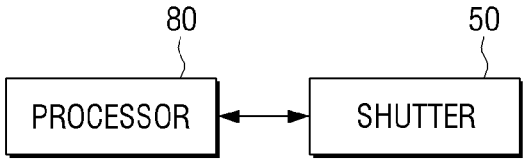
FIG. 8 is a block diagram illustrating a processor and a shutter.
Figure 9B:
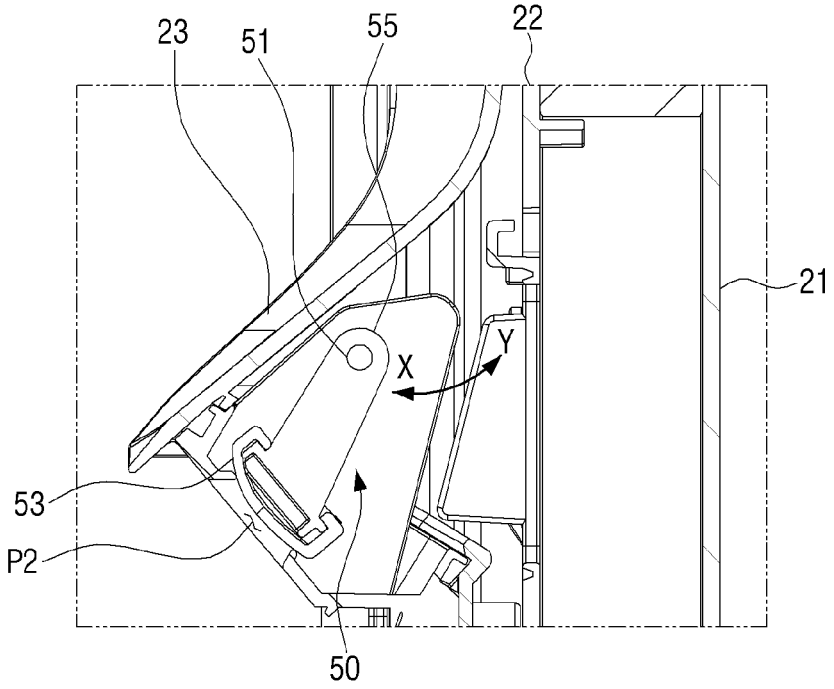
FIG. 9B is a cross-sectional view illustrating a close state of a shutter.

FIG. 8 is a block diagram illustrating a processor and a shutter 50, FIG. 9A is a cross-sectional view illustrating an open state of a shutter 50, and FIG. 9B is a cross-sectional view illustrating a close state of a shutter 50.

Referring to FIG. 8, the clothing treatment apparatus 1 may further include a processor 80 for controlling the operation of the shutter 50.

The processor 80 may include at least one of a central processing unit (CPU), a controller, an application processor (AP), or a communication processor (CP), and an ARM processor.

The processor 80 may control the clothing treatment apparatus 1. The processor 80, when a clothing process control command is input, may control each constituent element in the clothing process apparatus so that the operation according to the input clothing process control command may be performed.

In addition, the processor 80 may control the driving motor 52 to be in an opened state to close the second inlet P2 (see FIG. 9A) or a close state to close the second inlet P2 (see FIG. 9B).

Referring to FIG. 9A, the processor 80 may control the driving motor 52 so that the shutter 50 in an opened state may be spaced apart from the main air flow path MF.

The processor 80 may rotate the shutter 50 to be distant from the second inlet P2 so that the shutter 50 may not be disposed on the main air flow path MF in an open state in which the shutter 50 opens the second inlet P2.

Accordingly the shutter 50 may not block the main air flow path MF in an open state to maintain the main air flow path MF which is the shortest distance between the outside of the clothing treatment apparatus 1 and the accommodation space S, thereby improving the breathability of the clothing treatment apparatus 1.

Referring to FIG. 9B, the processor 80 may control the driving motor 52 to maintain the closing of the second inlet P2 in the closed state.

The closing unit 53 of the shutter 50 may increase the contact surface with the second inlet P2 to implement the complete closing through the complete contact with the second inlet P2, thereby increasing the friction force with the second inlet P2.

Therefore, if a continuous force is not applied to the closing unit 53 in a closed state blocking the second inlet P2, the closing unit 53 may be spaced apart from the second inlet P2, so that the close state blocking the second inlet P2 cannot be maintained.

Accordingly, the processor 80 may consistently operate the driving motor 52 so that the closing unit 53 may consistently close the second inlet P2.

As described above, the clothing treatment apparatus 1 equipped with the shutter 50 for selectively closing and opening the second inlet P2 may vent the outside of the clothing treatment apparatus 1 and the accommodation space S by opening the second inlet P2 when the clothing treatment apparatus 1 is not operated.

Therefore, the clothing treatment apparatus 1 may prevent a person entering the clothing treatment apparatus 1 from being suffocated.

When the clothing treatment apparatus 1 is operated, the shutter 50 may close the second inlet P2 to separate the accommodation space S from the outside of the clothing treatment apparatus 1.

Accordingly, air circulating inside the clothing treatment apparatus 1 may not be leaked to the outside of the clothing treatment apparatus 1, and thus the circulation efficiency and the processing efficiency of the clothing treatment apparatus 1 may be improved.

Hereinafter, referring to FIG. 10, the detailed operation of the clothing treatment apparatus 1 will be described.

Figure 10:
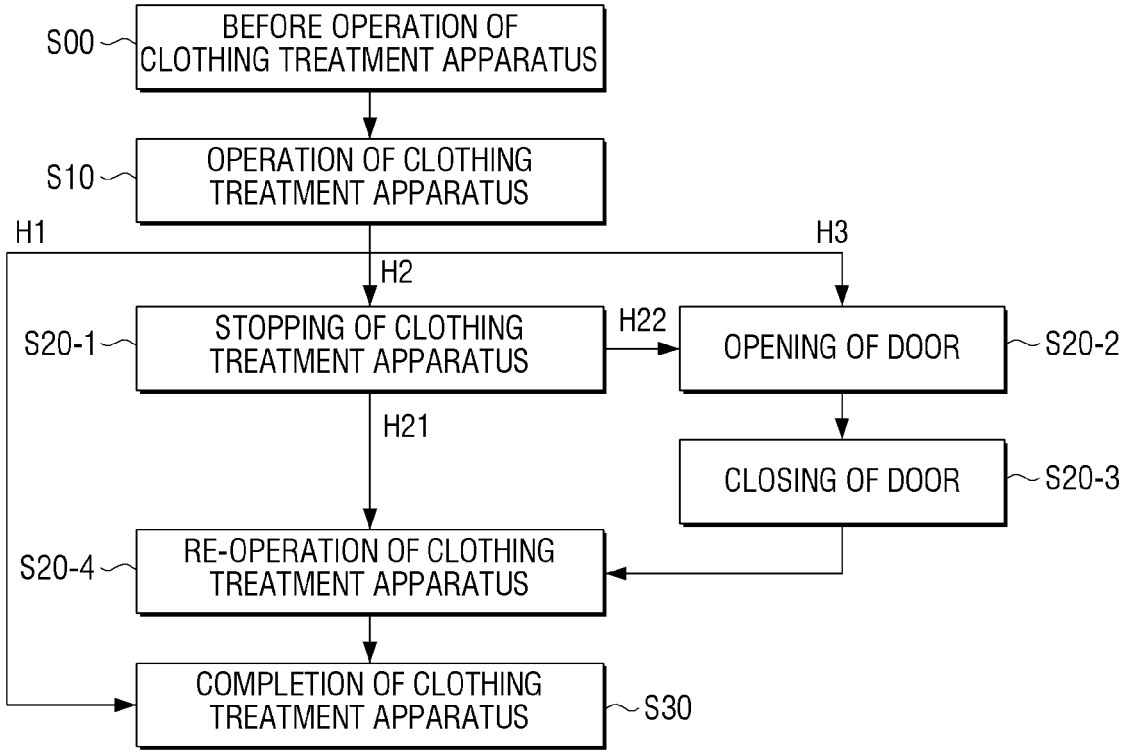
FIG. 10 is a flowchart to explain a controlling method of a clothing treatment apparatus according to an embodiment of the disclosure.

FIG. 10 is a flowchart to explain a controlling method of a clothing treatment apparatus according to an embodiment of the disclosure.

Before the clothing treatment apparatus 1 is operated in operation S00, the second inlet P2 may be in an open state. Therefore, the clothing treatment apparatus 1 may vent the accommodation space S and the outside of the clothing treatment apparatus 1.

The clothing treatment apparatus 1 including the accommodation space S in which the clothing C is place may operate in operation S10.

Through the operation signal input of a user, wrinkles may be stretched out by softening the fabrics of the clothing C by spraying hot steam discharged from the spray unit 30 to the clothing C. The clothing treatment apparatus 1 may spray the dehydrated air discharged from the spray unit 30 to the clothing C, and remove the wrinkles of the clothing C by drying the clothing C again.

In addition, the clothing treatment apparatus 1 may remove wrinkles by pressing the clothing C through a separate pressing means having a flat shape.

The clothing treatment apparatus 1 may remove the wrinkles of the clothing C effectively by compressing the clothing C by spraying steam to the front surface and the rear surface of the clothing C at the same time and then spraying compressed air onto the front surface and the rear surface in the same position of the clothing C.

The clothing treatment apparatus 1 may deodorize the smell of the clothing C by filtering hot steam or air passing through the clothing C and spraying the hot steam or air toward the clothing C.

When the clothing apparatus treatment apparatus 1 is operated in operation S10, the shutter 50 may rotate in a predetermined first direction X (see FIG. 9B) to close the second inlet P2 so that the outside and the accommodation space S are separated.

When a user continuously operates the clothing treatment apparatus 1 without opening the door 20 (H1), the operation and process of the clothing treatment apparatus 1 may be ended in a state in which the second inlet P2 is closed in operation S30.

When the clothing treatment apparatus 1 is operated, the operation of the clothing treatment apparatus 1 may be stopped according to user selection (H2). Since the shutter 50 may maintain the state in which the second inlet P2 is closed, air cannot still flow between the accommodation space S and the outside of the clothing treatment apparatus 1 in operation S20-1.

When a user operates the clothing treatment apparatus 1 again without opening the door 20 after the operation of the clothing treatment apparatus 1 is stopped (H21), the operation and process of the clothing treatment apparatus 1 may be performed without the change of the state in which the second inlet P2 is closed in operation S20-4.

When the user opens the door 20 after the operation of the clothing treatment apparatus 1 is stopped (H22), the second inlet P2 may maintain a closed state in operation S20-2.

When the opened door 20 is closed again in operation S20-3, the shutter 50 may rotate in the second direction Y opposite to the first direction X, so that the second inlet P2 may be opened.

Therefore, even if there is a person in the clothing treatment apparatus 1, in order to prevent the person from being suffocated, the second inlet P2 may be opened and the clothing treatment apparatus 1 may vent the accommodation space S and the outside of the clothing treatment apparatus 1.

When the clothing treatment apparatus 1 is operated again according to user selection in operation S20-4, the shutter 50 may close the second inlet P2 again by rotating in the first direction X.

In addition, after the clothing treatment apparatus 1 is operated, when the door 20 is opened (H3), the second inlet P2 may still maintain a closed state. In other words, when then door 20 is opened such as when the user adds the clothing C to the clothing treatment apparatus in the operation, the second inlet P2 may maintain a closed state.

When the door 20 is closed in operation S20-3, the shutter 50 may rotate in the second direction Y to open the second inlet P2. In other words, the second inlet P2 may be opened to prevent a person from being suffocated considering the case that a person is in the clothing treatment apparatus 1.

However, when the user operates the clothing treatment apparatus 1 again in operation S20-4, the shutter 50 may close the second inlet P2 by rotating in the first direction (X).

When the operation and process of the clothing treatment apparatus 1 is completed in operation S30, the shutter 50 may rotate in the second direction (Y) again and open the second inlet P2. Therefore, the air used in the clothing treatment apparatus 1 may be discharged to the outside.

However, the controlling method of the clothing treatment apparatus 1 described above may determine whether to open and close the second inlet P2 based on whether the door 20 is opened, but it is not limited thereto. The second inlet P2 may be opened by rotating the shutter 50 when it is detected that the person is in the clothing treatment apparatus 1 through a detection sensor (not shown) provided in the clothing treatment apparatus 1.

In other words, the opening of the second inlet P2 may be determined by the operation of the detection sensor (not shown) as well as whether the door 20 is opened.

In the above description, the various embodiments of the disclosure have been described separately, but each embodiment is not necessarily to be implemented alone, the configuration and operation of each embodiment is implemented in combination with at least one other embodiment.

Although embodiments have been shown and described, it will be appreciated by those skilled in the art that changes may be made to these embodiments without departing from the principles and spirit of the disclosure. Accordingly, the scope of the invention is not construed as being limited to the described embodiments, but is defined by the appended claims as well as equivalents thereto.

What is claimed is:

1. A clothing treatment apparatus, comprising:

a main body formed with a space to accommodate clothing;

a sprayer disposed inside the main body and configured to spray at least one of steam or air toward the clothing accommodated in the space; and a door hingedly coupled to the main body to open and close the space, wherein the door includes:

a front plate and a rear plate;

a first inlet disposed between the front plate and the rear plate to allow air from an outside to introduce in a gap between the front plate and the rear plate;

a second inlet connectable to the first inlet to allow the air from the outside which flows through the first inlet to flow into the space through the second inlet while the second inlet is connected to the first inlet; and a shutter configured to selectively move toward the second inlet to close the second inlet and thereby block the air from the outside flowing through the first inlet into the space and move away from the second inlet to open the second inlet and thereby allow the air from the outside flowing through the first inlet into the space when the door is closed.

2. The clothing treatment apparatus as claimed in claim 1, wherein the shutter comprises:

a rotational shaft connected to an inside of the door;

a driving motor connected to one side of the rotational shaft and configured to rotate the rotational shaft; and a closing member connectable to the rotational shaft and configured to close the second inlet as the rotational shaft rotates.

3. The clothing treatment apparatus as claimed in claim 2, wherein a shape of the closing member corresponds to a shape of the second inlet, and wherein an air tightness member to contact the second inlet is disposed on a surface of the closing member.

4. The clothing treatment apparatus as claimed in claim 2, further comprising:

a processor configured to control the driving motor to be in an open state that opens the second inlet and a closed state that closes the second inlet.

5. The clothing treatment apparatus as claimed in claim 4, wherein the first inlet and the second inlet form a main air flow path for the air from the outside to flow into the space, and wherein the processor is further configured to control the driving motor to allow the shutter to be spaced apart from the main air flow path in the open state.

6. The clothing treatment apparatus as claimed in claim 4, wherein the processor is further configured to control the driving motor to maintain the second inlet closed while the driving motor is in the closed state.

7. The clothing treatment apparatus as claimed in claim 1, further comprising:

a processor configured to control a driving motor of the shutter;

wherein the processor controls the driving motor of the shutter to maintain the shutter away from the second inlet to open the second inlet when an operation of the clothing treatment apparatus is restarted subsequent to being stopped and the door has remained closed for duration of a time the clothing treatment apparatus is stopped and restarted.

8. A controlling method of a clothing treatment apparatus, the method comprising:

operating a clothing treatment apparatus which includes a space to accommodate clothing and a door including a front plate, a rear plate, a first inlet formed between the front plate and the rear plate and a second inlet;

closing the second inlet that allows air to flow from an outside to the space as a shutter rotates in a first direction to thereby block the air from the outside flowing through the first inlet into the space; and opening the second inlet to thereby allow the air from the outside flowing through the first inlet into the space as the shutter rotates in a second direction opposite to the first direction after the operating of the clothing treatment apparatus ends.

9. The controlling method as claimed in claim 8, further comprising:

stopping the clothing treatment apparatus from being operated while the door is open; and opening the second inlet as the shutter rotates in the second direction after the door is closed.

10. The controlling method as claimed in claim 9, further comprising:

re-operating the clothing treatment apparatus; and closing the second inlet as the shutter rotates in the first direction.

11. A clothing treatment apparatus, comprising:

a sprayer configured to spray at least one of steam or air toward an inner space of the clothing treatment apparatus; and a door including:

a front plate and a rear plate;

a flow path formed by a first inlet formed between the front plate and the rear plate and a second inlet to allow air from outside the clothing treatment apparatus to flow toward the inner space; and a shutter configured to move toward the second inlet to close the second inlet to thereby block the air from the outside flowing through the first inlet into the inner space while the sprayer is operated and move away from the second inlet to open the second inlet to thereby allow the air from the outside flowing through the first inlet into the space while the sprayer is not operated.

12. The clothing treatment apparatus as claimed in claim 11, wherein the flow path formed by the first inlet and the second inlet is a first flow path, and the clothing treatment apparatus further comprises:

second flow paths through which the at least one of steam or the air from the sprayer is sprayed toward the inner space.

* * * * *